US008473336B1

(12) United States Patent
Simmons

(10) Patent No.: US 8,473,336 B1
(45) Date of Patent: Jun. 25, 2013

(54) RESOURCE ACCESS CONTROL METHOD AND SYSTEM FOR IMPRINTING A PRODUCT OR SERVICE ON THE MIND OF A USER OF AN ONLINE RESOURCE

(75) Inventor: Russel E. Simmons, San Francisco, CA (US)

(73) Assignee: Jared Kopf, San Francisco, CA (US)

( * ) Notice: Subject to any disclaimer, the term of this patent is extended or adjusted under 35 U.S.C. 154(b) by 2287 days.

(21) Appl. No.: 10/945,708

(22) Filed: Sep. 20, 2004

(51) Int. Cl.
*G06Q 30/00* (2012.01)

(52) U.S. Cl.
USPC ..... 705/14.1

(58) Field of Classification Search
USPC ..... 705/14, 14.1
See application file for complete search history.

(56) References Cited

U.S. PATENT DOCUMENTS

| | | | | |
|---|---|---|---|---|
| 7,337,324 | B2 * | 2/2008 | Benaloh et al. | 713/182 |
| 7,430,720 | B2 * | 9/2008 | Hua et al. | 715/753 |
| 2004/0107139 | A1 * | 6/2004 | Shibanuma | 705/14 |
| 2005/0144067 | A1 * | 6/2005 | Farahat et al. | 705/14 |

OTHER PUBLICATIONS

Louis Von Ahn, Manuel Blum and John Langford, "Telling Humans and Computers Apart Automatically", Communications of the ACM, Feb. 2004, vol. 47, No. 2, pp. 57-60.
Present application: Background starting at paragraph [0001] on p. 2 and ending at paragraph [0010] p. 5.

* cited by examiner

*Primary Examiner* — Daniel Lastra
(74) *Attorney, Agent, or Firm* — Patent Authority LLC; Elliot Furman

(57) ABSTRACT

A request is received from a client computer to access an online resource. Access to the online resource is controlled by a server. In response to the request, the server transmits advertising content for a product or service to be displayed on the client computer. The server also transmits an input request to be displayed by the client computer. The input request asks for information about the product or service that is being advertised. The information is available to the user by comprehending the advertising content. The server receives an input response from the client computer. If the input response comprises the correct information requested by the input request, the server permits the client computer to access the online resource.

18 Claims, 15 Drawing Sheets

RESOURCE ACCESS CONTROL METHOD AND SYSTEM FOR IMPRINTING A PRODUCT OR SERVICE ON THE MIND OF A USER OF AN ONLINE RESOURCE

BACKGROUND

Captchas

Many different applications in a computer networked environment (such as the Internet) request input from a user where the user is expected to be human and not a machine. For example, email service software may be written to ask a potential user, in order to set up the potential user's account, for a unique email address and password. Here, it is expected that the potential user is a human and not a machine. As another example, "on-line voting" applications are generally intended to tally votes submitted only from humans.

Unfortunately, at least some applications that are intended to receive only human input at certain instances have been misused by "bots". Bots are machines, typically one or more computing systems executing software, that subvert an application's purpose by responding to a request for input made by that application that was intended to be responded to by a human.

For example, in the case of free email services, "spammers" (those who seek to anonymously send unsolicited emails) have established bots that step through an email service's user account setup procedure to automatically generate—in a relatively short time period—thousands of email addresses that can be used as the source address for "spam" email messages. In the case of on-line voting applications, bots have been authored that repeatedly vote for a particular candidate in order to generate artificially large numbers of votes for the candidate.

In order to prevent a bot from responding to a request that was intended to be responded to by a human, applications that are susceptible to misuse from bots have integrated "captchas" into their input request procedures. The word "captcha" derives from the acronym CAPTCHA (Completely Automated Public Turing test to tell Computers and Humans Apart) which was coined by artificial intelligence researchers at Carnegie-Mellon University.

The word "captcha" or phrase "captcha test", however, has taken on its own momentum and is now understood to refer to any test, typically implemented with software (i.e., program code and/or data in a format used by program code), that includes "content" and an input request; where, a human can easily comprehend "human perceptible content" from the "content" in order to provide a correct response to the input request; but, a computer can not easily comprehend the human perceptible content from the content in order to provide a correct response to the input request.

FIG. 1 shows a basic example of one type of visual captcha. Visual captchas are based on the premise that, at least in some circumstances, humans have superior visual recognition skills as compared to computers. In the case of visual captcha tests of the type presented in FIG. 1, the "content" corresponds to a visual presentation that includes human recognizable content which has been manipulated according to some scheme. In order to prevent a machine (e.g., a bot) but not a human from "passing" the test, the responder is supposed to comprehend the human perceptible content from the content in order to provide the correct input response to the input request.

Thus, in order to implement the captcha test of FIG. 1, a file representing content 100 and an input request is downloaded from a server to a client. The content 100 is displayed on the client's display and the input request, which is also displayed on the client's display within a pop-up window 101, asks the responder to enter the four letters that are observed in the content 100. The response to the input request is sent from the client back to the server. The server then compares the submitted response to the correct response.

Here, the human perceptible content that is discernable from the content 100 corresponds to the undistorted letter series "s", "m", "w" and "m" (i.e., the manipulation of the human perceptible content "smwm" results in the content 100 observed in FIG. 1). From the structure of the input request, the responder is supposed to comprehend the "human perceptible content" from the "content" if the correct response is to be provided. A human responder can easily comprehend the human perceptible content (i.e., the undistorted letter series "s", "m", "w" and "m") from the content 100 in order to answer the input request correctly. By contrast, a computer can not easily comprehend an undistorted letter series of "s", "m", "w" and "m" from the content 100 in order to answer the input request correctly.

That is, owing to the superior ability of humans to recognize distorted letters as compared to computers, humans are able to easily provide the correct response to the input request. By contrast, executable program code configured to analyze the content 100 can not easily provide the correct response to the input request. As such, should the responder be a bot, there is a significant likelihood that the response to the input request will be incorrect.

Thus, through the use of captchas, bots can be substantially prevented from accessing an application in areas of the application where only a human's input is desired. In the case of the aforementioned email service abuses, bots developed by spammers are apt to be prevented from generating thousands of email addresses; and, in case of on-line voting, bots are apt to be prevented from running up an artificially high vote count for a particular candidate.

FIGURES

The present invention is illustrated by way of example, and not limitation, in the figures of the accompanying drawings in which like references indicate similar elements and in which.

DETAILED DESCRIPTION

Captcha tests can be enhanced with advertisements to extend their utility. That is, a captcha test designed to include one or more advertisements can not only provide a measure of security against bots (e.g., by denying further access to some on line service) but also generate revenue as valuable advertising space. Moreover, by structuring the captcha test to force a human responder to comprehend the advertisement in order to "pass" the test, the test becomes an extremely effective advertising tool. That is, by designing a captcha test to condition access to a particular on-line service to only those who can pass the test, the providers of the service can create an environment where those who access their service are not only human but are also forced to comprehend an advertisement beforehand.

Figure 2:
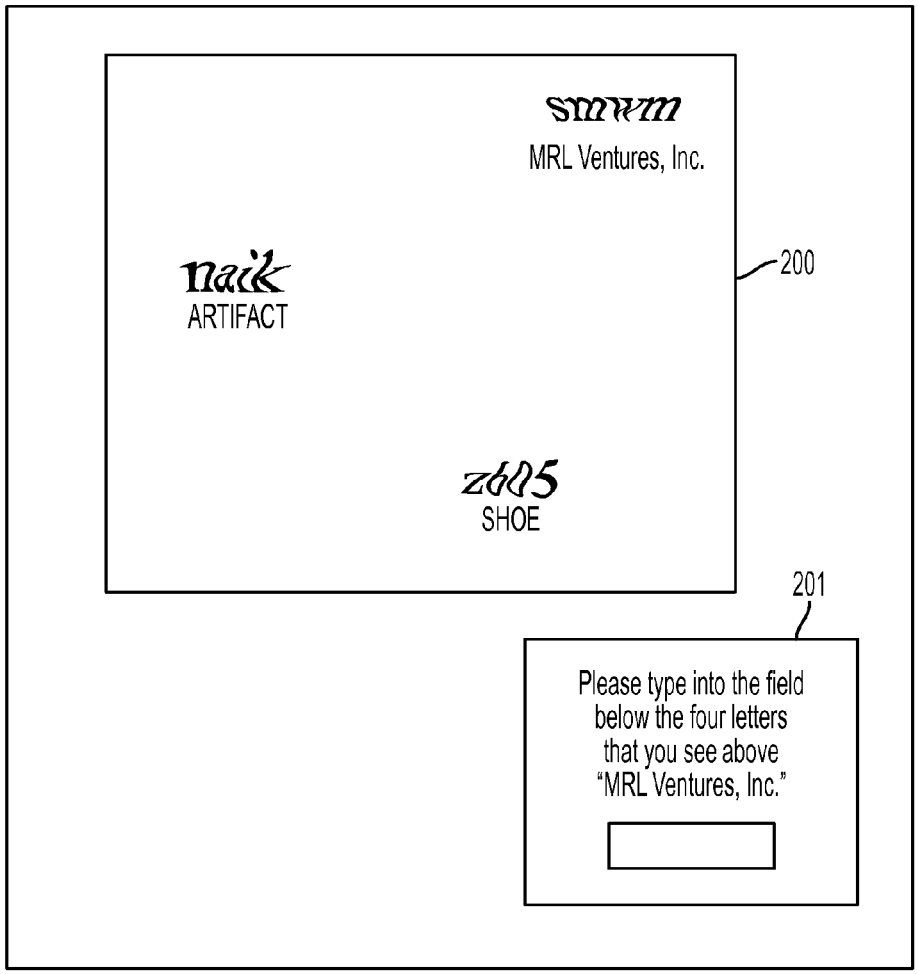
FIG. 2 shows a first embodiment of a captcha test that includes an advertisement.

FIG. 2 shows an example of a visual captcha test whose content (i.e., image 200) and input request 201 each include an advertisement for MRL Ventures, Inc. Note that the structure of the input request 201 is designed to force a human responder to comprehend the advertisements for MRL Ventures, Inc. if the human responder is to respond to the input request correctly.

That is, firstly, the content 200 is laid out and the input request 201 is structured to force the responder to search for and find the phrase "MRL Ventures, Inc." from the content 200. Secondly, the responder has to actually read the phrase "MRL Ventures, Inc." within the question poised by the input request 201. Thus, if the captcha test of FIG. 2 is to be successfully passed by a human responder, the phrase "MRL Ventures, Inc." will have actually reached the mind of the human responder in at least two instances.

Figure 1:
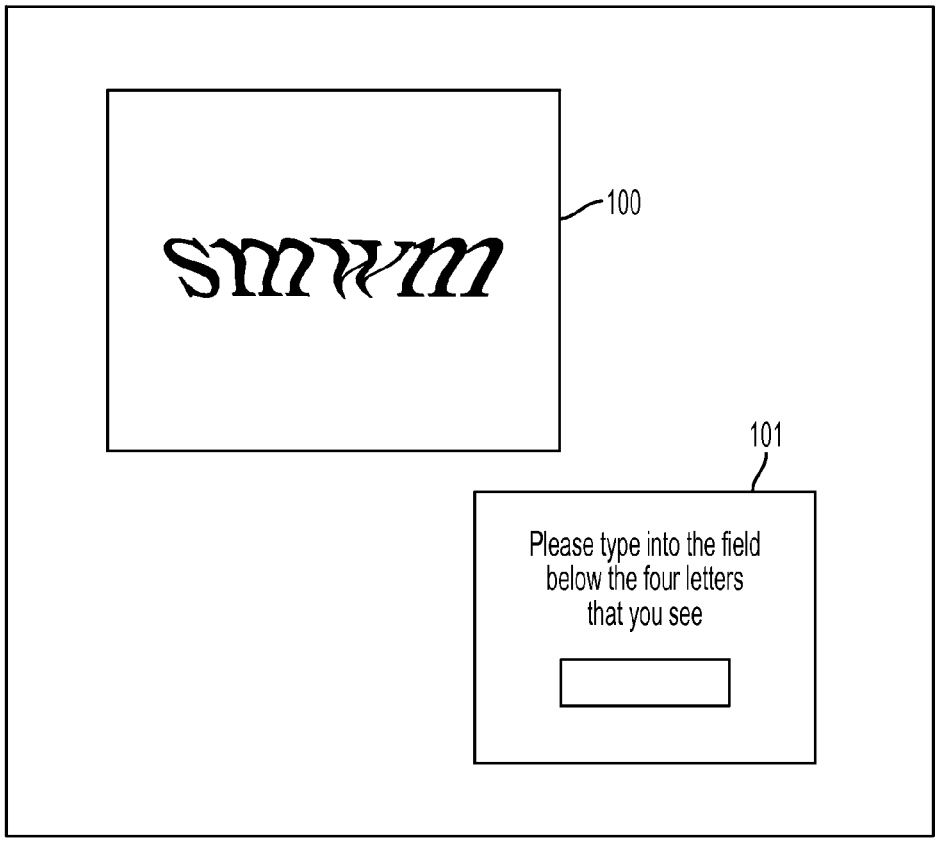
FIG. 1 PRIOR ART
FIG. 1 shows a prior art captcha test.

Consistent with practicalities of implementing a captcha test, in order for a captcha test to circumvent a bot, the correct input response should be based on a feature that can be easily randomized (e.g., a sequence of letters and/or numbers, one or more shapes, one or more locations within an image, one or more sounds, combinations thereof, etc.). The captcha test of FIG. 2 meets this objective in that, like the example provided with respect to FIG. 1, the correct input response is the random letter sequence "smwm". As such, a computing system (e.g., a server) that is responsible for generating a series of captcha tests for downloading to various clients, can randomly generate different correct responses for the various downloaded tests.

Better said, a computing system that is responsible for generating multiple instances of the captcha test could be configured to randomly generate different four letter sequences to be located above the phrase "MRL Ventures, Inc" in order to secure its effectiveness against bots. In a further embodiment, the position within the content 200 of both the "MRL Ventures, Inc." advertisement and the distorted four letter sequence above it may be randomized from test to test.

In an even further embodiment, more than one advertisement may be included in the captcha test. For example, referring to FIG. 3, the image now includes a pair of advertisements (one for "MRL Ventures, Inc." and another for "Blakely, Sokoloff, Taylor and Zafman, LLP"). Each advertisement is beneath its own distorted sequence of letters. Here, a computing system responsible for generating multiple instances of the captcha test of FIG. 3 could randomly choose between which advertisement was to be used as a basis for finding the distorted four letter sequence used for the correct input response.

Figure 3:
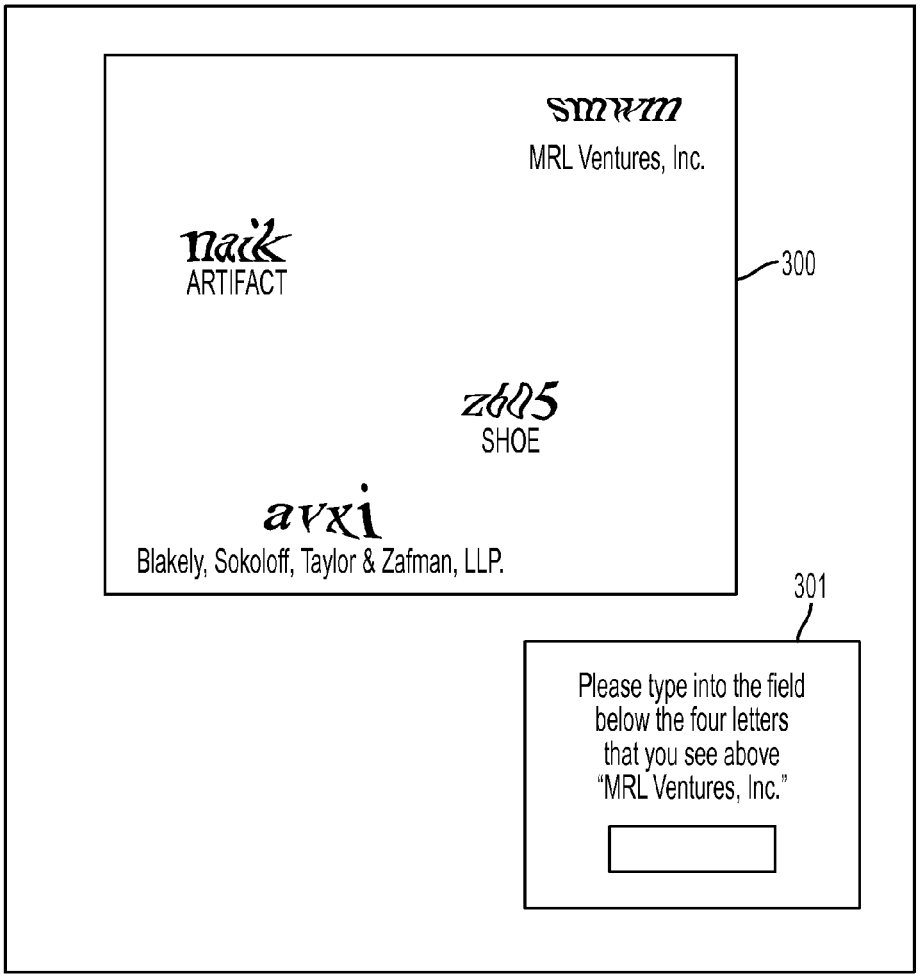
FIG. 3 shows a second embodiment of a captcha test that includes an advertisement.

It should be apparent that even though the advertisements themselves in the content 200, 300 of FIGS. 2 and 3 are not distorted there may even exist further alternate embodiments in which the advertisements themselves are distorted or otherwise manipulated. That is, at a higher level of abstraction, the advertisement is found within the human perceptible content. Moreover, it should be clear that various captcha tests can be crafted where an advertisement is found in the content and in the input request (such as the tests observed in FIGS. 2 and 3), or, an advertisement is found in the content but not the input request, or, the advertisement is found in the input request but not the content.

The "content" of a captcha test is whatever is presented to the responder as a basis for answering the input request. For the visual captcha tests of FIGS. 1, 2 and 3, the content is image 100, 200 and 300, respectively. As human responders are the intended target, the environment of the content should appeal to one or more human perception skills (e.g., sight, sound, etc.).

Some possible advertisement enhanced captcha test content formats may include but are not limited to: 1) text recognition (e.g., GIMPY: rendering of a plurality of distorted words and/or letters with the input request calling for at least some of the words and/or letters); 2) visual pattern(s) recognition (e.g., BONGO: rendering of shapes grouped into categories of likeness with the input request calling for which category another shape belongs to, PIX based: random display of images/pictures with the input request calling for the responder to identify the images/pictures); and, 3) sound recognition (e.g., presentation of distorted audio words and/or numbers with the input request calling for identification of the words and/or numbers).

Further advertisement enhanced captcha test content formats might make use of a human's cultural knowledge such as, for example, common sense, tradition and/or trivia based. An example includes a captcha test whose content includes an image of Marilyn Monroe holding a product being advertised and whose input request prompts the responder to name the celebrity that is observed and the name of the product the celebrity is holding.

The format for the input request may vary from embodiment to embodiment as well. For example, some advertisement enhanced captcha tests may require the responder to type in text. Other advertisement enhanced captcha tests may require the responder to make a mouse-click selection from a multiple choice offering that is provided as part of the input request.

As discussed, captcha tests are useful when it is important to confirm that a human is involved in a communication transpiring over a computer network. Typical uses for advertisement enhanced captcha tests are expected to include but are not limited to: 1) registration processes (e.g., a captcha is presented to the responder before the responder is permitted to enter registration information (e.g., name, address, etc. entered for signing up to a service and/or application and/or database) or before the responder's registration information is officially accepted); 2) login processes (e.g., a captcha test is presented to the responder before the responder is permitted to enter login information (e.g., userid, password, etc. entered for gaining permission to access a service and/or application and/or database) or before the responder's login information is officially submitted for login purposes); 3) email services (e.g., denying a client an email account if the client cannot pass a captcha test); 4) on line voting (e.g., denying a client's ability to vote if the client cannot pass a captcha test); 5) web based monetary services (e.g., conditioning the transfer of money on the ability of the transferor and/or transferee to pass a captcha test); 6) web based searches s (e.g., enforcing the passing of a captcha test before allowing a search to be performed such as a domain name search); 7) web based message posting (e.g., forcing a client to pass a captcha test before the client is permitted to post a message on a message board (e.g., within a blogging community)); and 8) web based bidding (e.g., forcing a client to pass a captcha test before the client is permitted to make a bid or understand a bid made by another). It is expected that any of the captcha test uses described above could use captcha tests that have been enhanced with advertisement(s).

Figure 4:
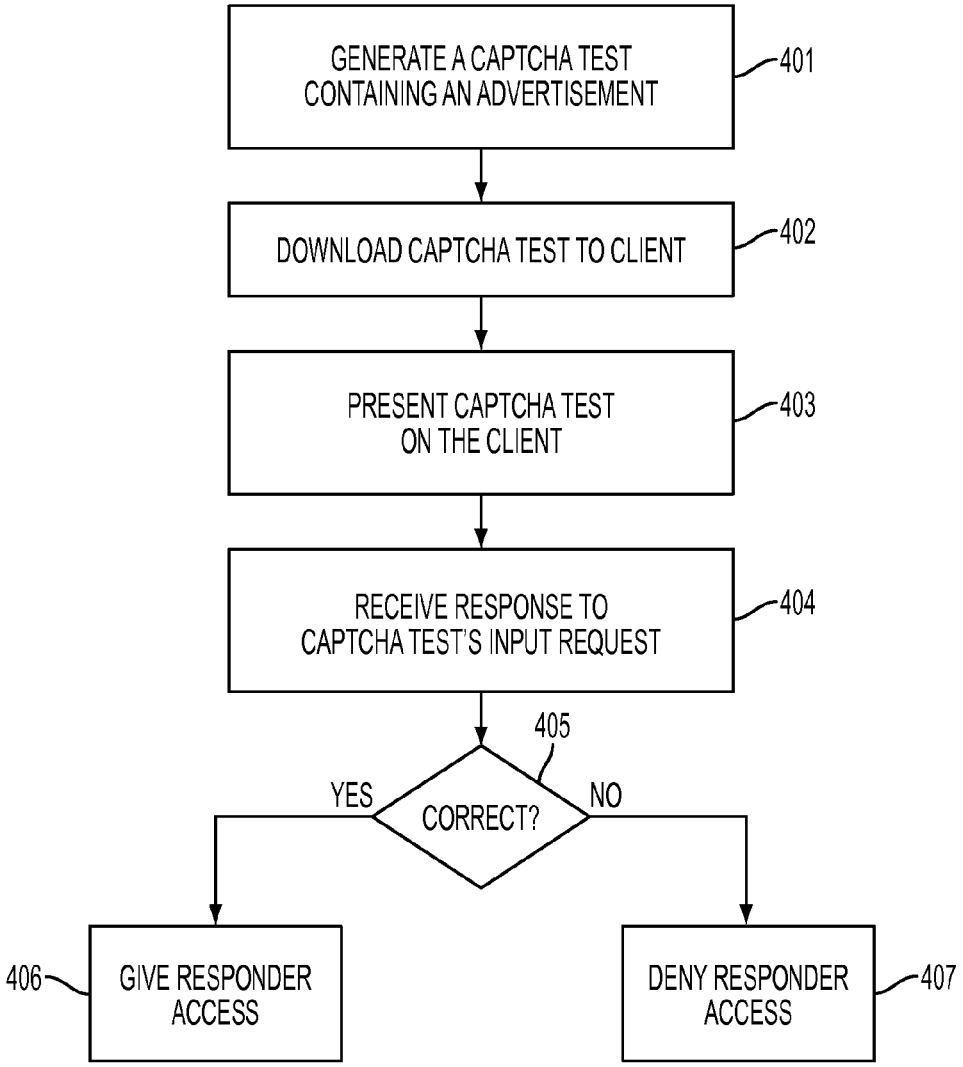
FIG. 4 shows a process for accepting/denying further access to a service and/or application and/or database based upon the results of a captcha test.
Figure 5:
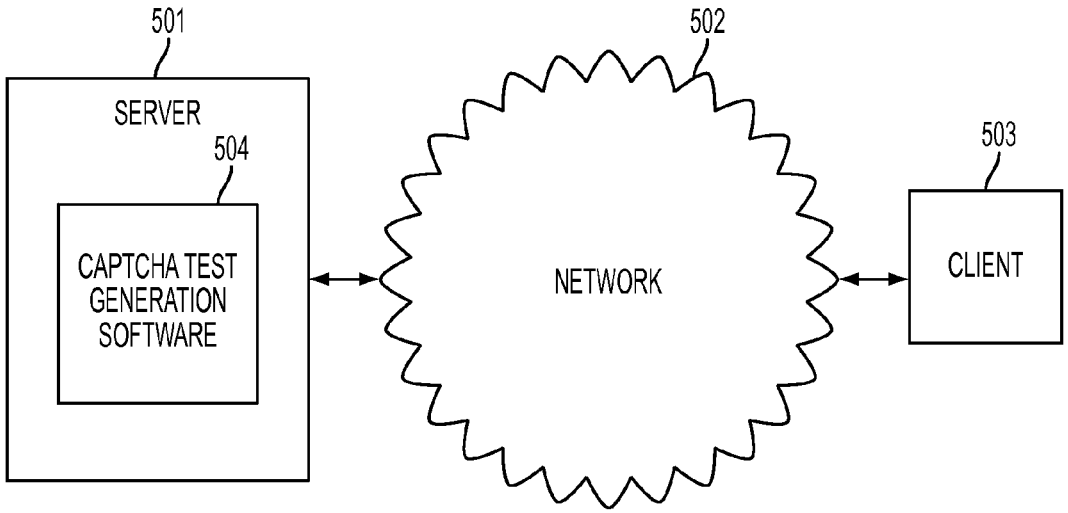
FIG. 5 shows a server containing captcha test generation software and a client upon which a captcha test is given.

FIGS. 4 and 5 relate to a process for accepting/denying further access to a resource over a network such as an on line service and/or application and/or database based upon the results of a captcha test. According to the methodology of FIG. 4, a captcha test containing an advertisement is generated 401 at a server 501 having captcha test generation software 504. The generated captcha test (e.g., in the form of a file) is then downloaded 402 over a network 502 to the client 503 as a consequence of some action being taken at the client 503 (e.g., execution or attempt to execute a registration process, a login process, etc.). The captcha test content and input request are presented 403 to the responder at the client 503; where, either or both of the content and the input request contain an advertisement.

The responder's response to the input request is sent back 404 to the server 501. If the response to the input request is correct 405, the responder is permitted 406 to entertain further access and use into whatever service and/or application and/or database the responder is attempting to use. If the response to the input request is incorrect 405, the responder is not permitted 407 to entertain further access and use into whatever service or application or database the responder is attempting to use.

According to one embodiment, the server 501 is run by the service provider that maintains the web based service and/or web based application and/or web based database that the responder is attempting to use/access. According to another embodiment, however, the server 501 is run by a 3$^{rd}$ party that performs the captcha test generation 401 and test checking 405 functions as a service for the aforementioned service provider. Here, essentially, the service provider invokes the use of the 3$^{rd}$ party's server 501 whenever the service provider recognizes a need to download a captcha test to one of its clients.

According to one approach, the service provider directs the client's session to the 3$^{rd}$ party, at which point, the 3$^{rd}$ party can manage/oversee the execution of the captcha test. The service provider simply waits until, after the test is completed, the 3$^{rd}$ party informs the service provider whether or not the responder at the client passed the captcha test or not. If the responder passed the test the service provider permits use/access of its service to the responder. If the responder did not pass the test the service provider does not permit use/access of its service to the responder.

According to another approach, the 3$^{rd}$ party provides to the service provider the program code and/or file(s) for presenting the captcha test to the client and the service provider provides the 3$^{rd}$ party with the responder's response. The 3$^{rd}$ party then determines if the responder's answer was correct and informs the service provider of the result.

It is expected that at least some of the useful advertisement matter that could be included in a captcha test would include a registered trademark and/or a copyrighted work.

Presently it is believed that the most effective captcha tests will be those that embed the advertisement with the human perceptible content needed to be comprehended by a human responder in order to pass the captcha test, or, those whose input requests require the responder to type the advertisement itself. Examples of both include, the aforementioned captcha test having content that includes an image of Marilyn Monroe holding a product being advertised and whose input request prompts the responder to name the celebrity that is observed and the name of the product the celebrity is holding. Another example is a captcha test having content that includes an image of a particular make of car and whose input request asks the responder to identify the make of car as well as its license plate number.

Processes taught by the discussion above may be performed with program code such as machine-executable instructions which cause a machine (such as a "virtual machine", general-purpose processor or special-purpose processor) to perform certain functions. Alternatively, these functions may be performed by specific hardware components that contain hardwired logic for performing the functions, or by any combination of programmed computer components and custom hardware components.

An article of manufacture may be used to store program code. An article of manufacture that stores program code may be embodied as, but is not limited to, one or more memories (e.g., one or more flash memories, random access memories (static, dynamic or other)), optical disks, CD-ROMs, DVD ROMs, EPROMs, EEPROMs, magnetic or optical cards or other type of machine-readable media suitable for storing electronic instructions. Program code may also be downloaded from a remote computer (e.g., a server) to a requesting computer (e.g., a client) by way of data signals embodied in a propagation medium (e.g., via a communication link (e.g., a network connection or datagram flow)).

Figure 6:
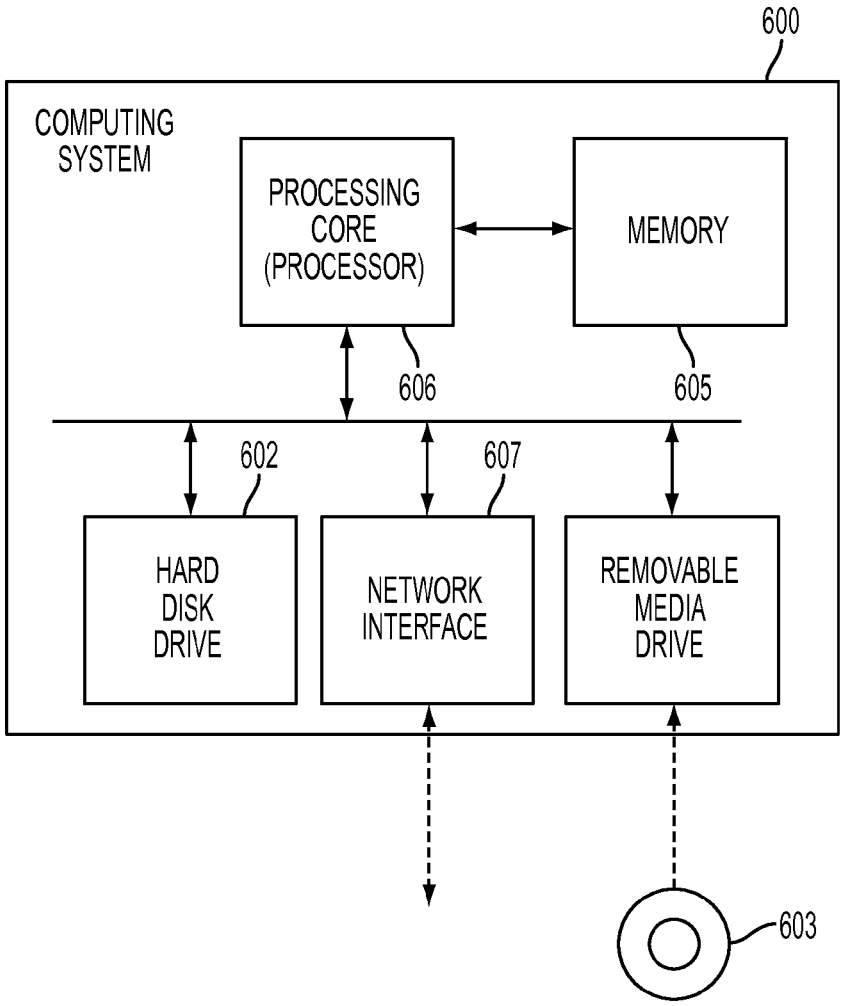
FIG. 6 shows a depiction of a computing system.
Figure 7:
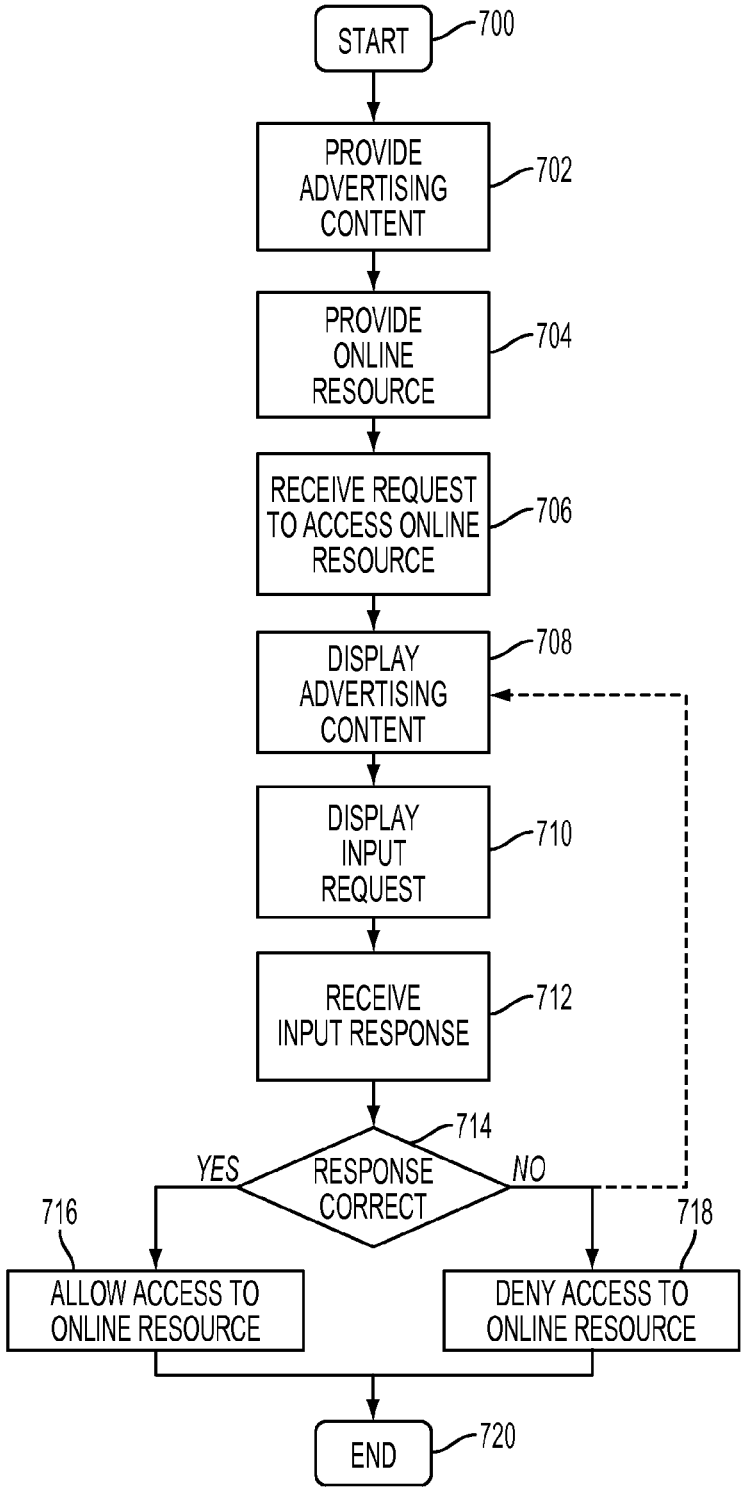
FIG. 7 shows a resource access control method.
Figure 8:
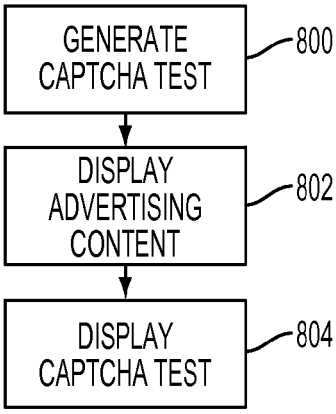
FIG. 8 shows the steps of displaying advertising content.
Figure 9:
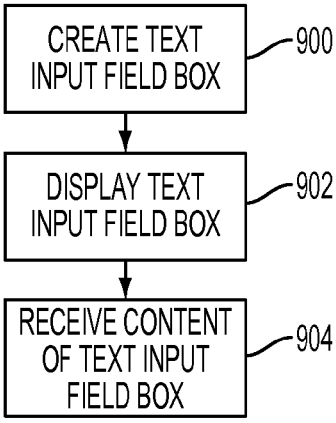
FIG. 9 shows a text input field box method.
Figure 10:
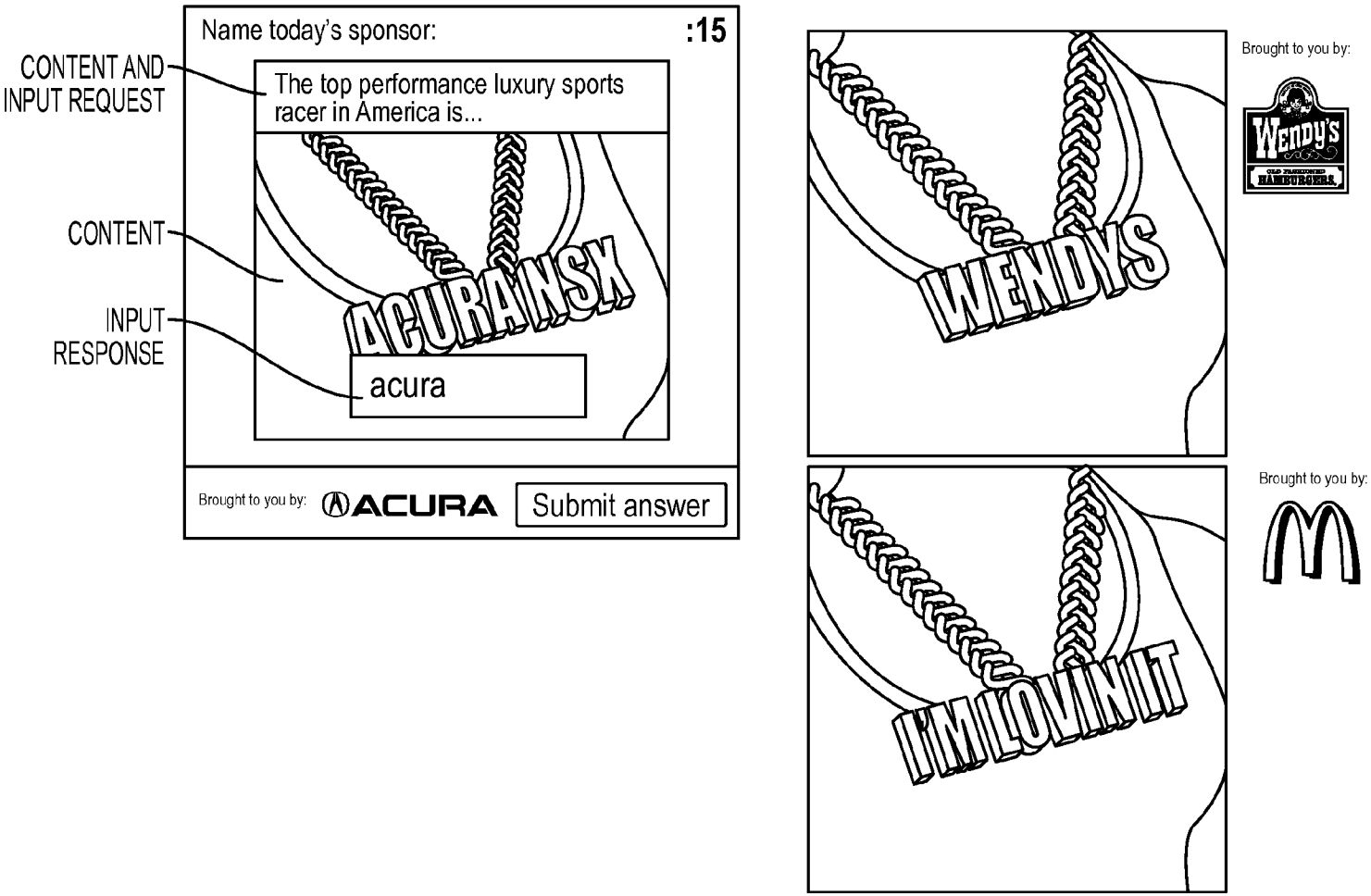
FIGS. 10-16 show exemplary advertising content and input requests.
Figure 11:
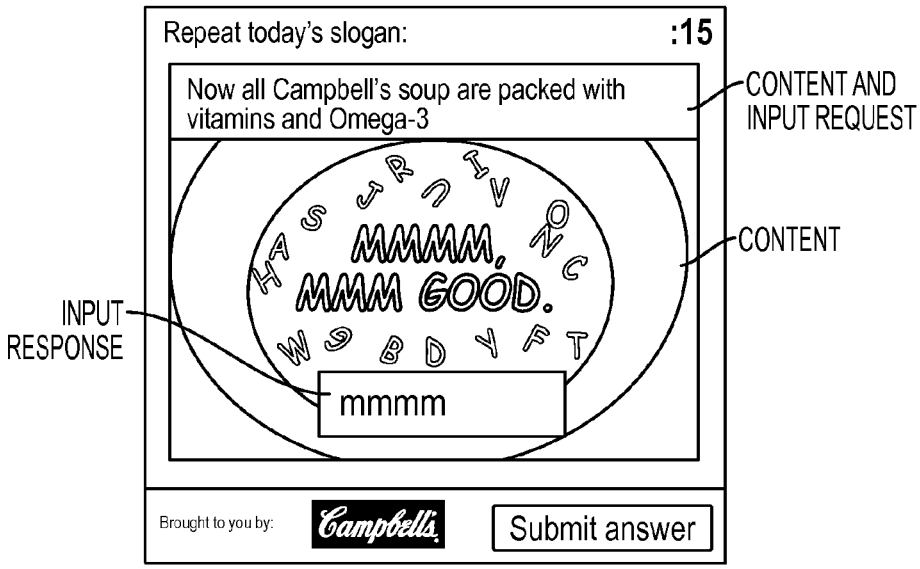
Figure 12:
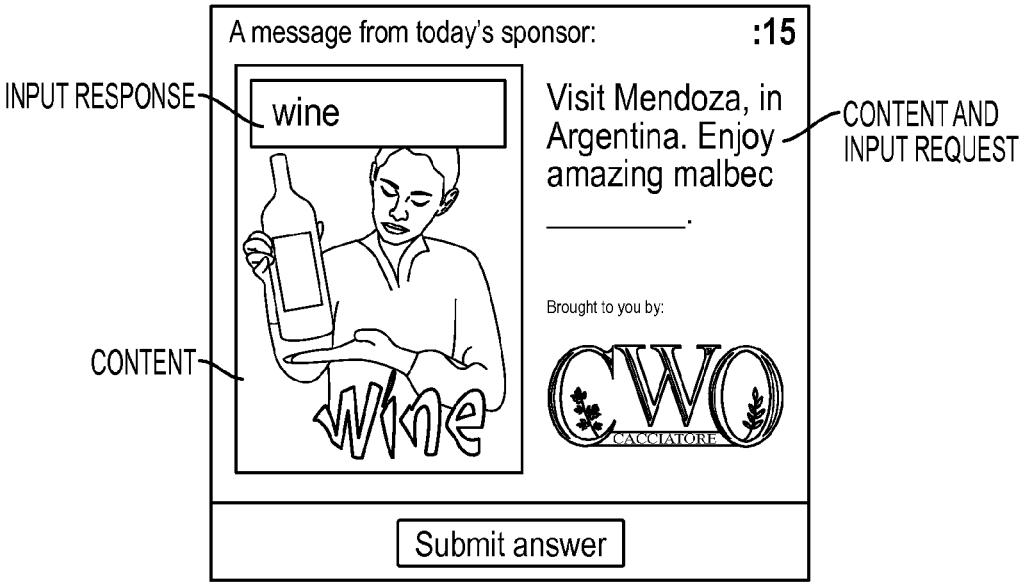
Figure 13:
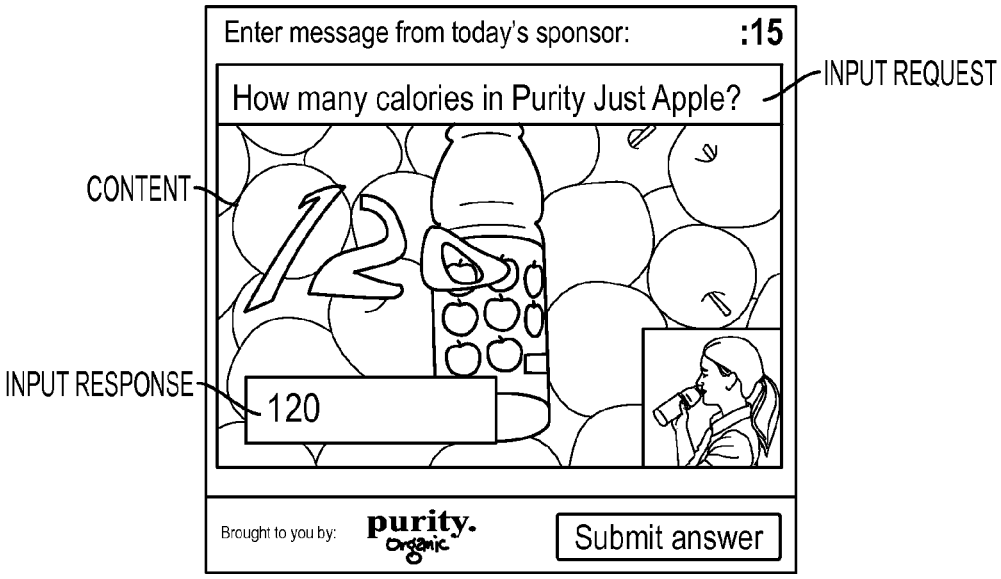
Figure 14:
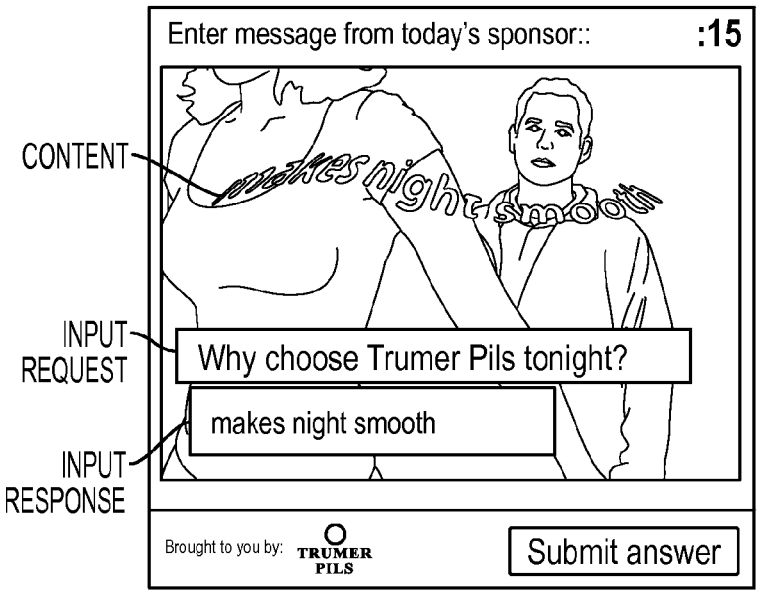
Figure 15:
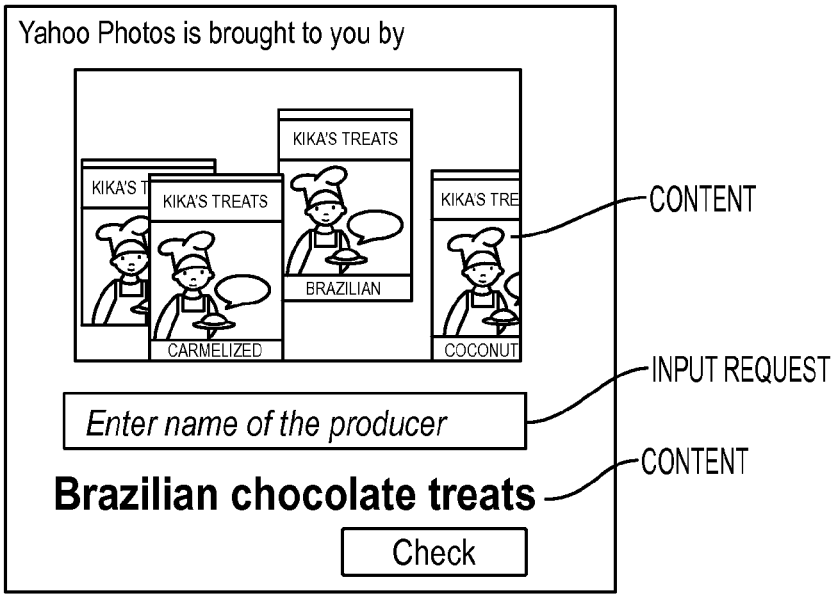
Figure 16:
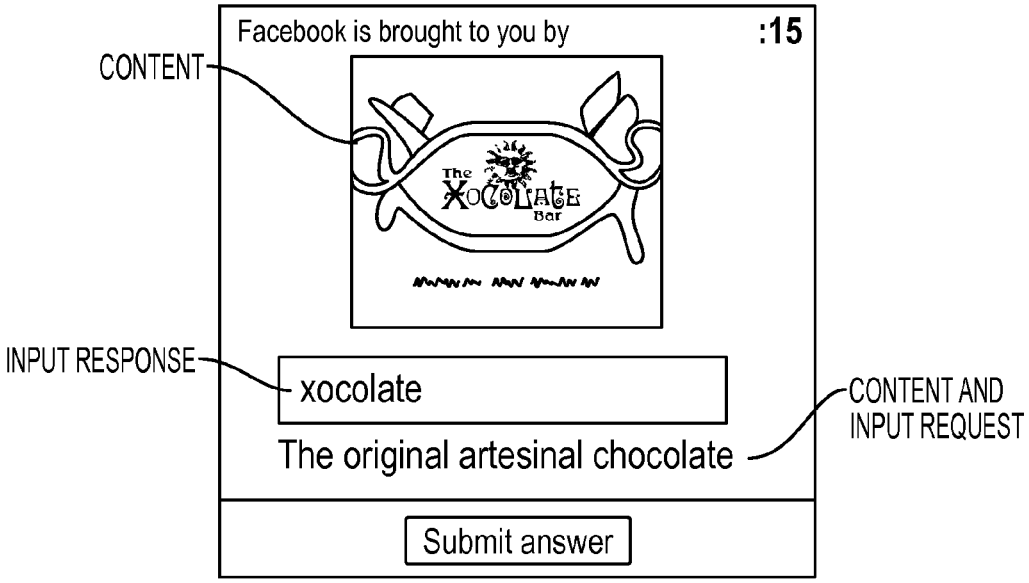

FIG. 6 is a block diagram of a computing system 600 that can execute program code stored by an article of manufacture. It is important to recognize that the computing system block diagram of FIG. 6 is just one of various computing system architectures. The applicable article of manufacture may include one or more fixed components (such as a hard disk drive 602 or memory 605) and/or various movable components such as a CD ROM 603, a compact disc, a magnetic tape, etc. In order to execute the program code, typically instructions of the program code are loaded into the Random Access Memory (RAM) 605; and, the processing core 606 then executes the instructions.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

The invention claimed is:

1. A resource access control method comprising the steps of:

(a) providing advertising content from an advertiser stored on a server, wherein the advertising content comprises correct information about a product or service;

(b) providing an online resource to which access is controlled by the server;

(c) receiving an electronic request from a client computer to access the online resource;

(d) displaying the advertising content on the client computer;

(e) displaying an input request on the client computer to provide information about the product or service, wherein the information is available from the advertising content;

(f) receiving an input response from the client computer to the input request;

(g) if the input response comprises the correct information, (1) allowing the client computer to access the online resource;

(2) charging the advertiser for the advertisement; and (h) if the input response does not comprise the correct information, not charging the advertiser wherein the step of not charging comprises displaying the advertising content in (d) free of charge.

2. The method of claim 1 wherein the input request comprises a question about the product or service.

3. The method of claim 1 wherein the advertising content further comprises the input request in (e).

4. The method of claim 1 wherein the displaying in (d) comprises:

(i) generating a captcha test;

(ii) displaying the advertising content; and (iii) displaying the captcha test.

5. The method of claim 4 wherein the displaying in (iii) comprises displaying the captcha test over the advertising content.

6. The method of claim 1, wherein the step of displaying in (e) comprises, creating a text input field box;

displaying the text input field box on the client computer; and wherein the step of receiving an input response in (f) comprises, receiving contents of the text input field box.

7. The method of claim 1 wherein the advertising content comprises at least one of text or an image.

8. The method of claim 1 wherein the advertising content comprises at least one of video or audio.

9. The method of claim 1 wherein the advertising content comprises at least one of a product name, a company name, a slogan, a fact, or a logo.

10. The method of claim 1 wherein the advertising content comprises at least one of a trademark, a service mark, or a copyright.

11. The method of claim 1 wherein the advertising content comprises the correct information.

12. The method of claim 1 wherein the correct information of (g) comprises human perceptible content.

13. The method of claim 1 wherein the online resource is not a website related to the product or service.

14. A resource access control system comprising:

means for providing advertising content from an advertiser stored on a server, wherein the advertising content comprises correct information about the product or service;

means for providing an online resource to which access is controlled by the server;

means for receiving an electronic request from a client computer to access the online resource;

means for displaying the advertising content on the client computer;

means for displaying an input request on the client computer to provide information about the product or service, wherein the information is available from the advertising content;

means for receiving an input response from the client computer to the input request; and allowing means for, if the input response comprises the correct information, allowing the client computer to access the online resource; and charging the advertiser for the advertisement; and free displaying means for, if the input response does not comprise the correct information, not charging the advertiser and displaying the advertising content free of charge.

15. The system of claim 14 further comprising captcha test means for displaying the captcha test with the advertising content.

16. A computer program product comprising a computer readable medium comprising a computer readable program, wherein the computer readable program when executed by a microprocessor on a computer causes the computer to:

(a) provide advertising content from an advertiser, wherein the advertising content comprises correct information about a product or service;

(b) control access to an online resource;

(c) receive an electronic request from a client computer to access the online resource;

(d) display the advertising content on the client computer;

(e) display an input request on the client computer to provide information about the product or service, wherein the information is available from the advertising content;

(f) receive an input response from the client computer to the input request; and (g) if the input response comprises the correct information, (1) allow the client computer to access the online resource;

(2) charge the advertiser for the advertisement; and (h) if the input response does not comprise the correct information, not charge the advertiser and display the advertising content in (d) free of charge.

17. A resource access control system comprising:

a communication network;

a client computer in communication with the communication network; and a server in communication with the communication network, the server comprising a storage device and a microprocessor, the storage device comprising computer executable code which when executed by the microprocessor causes the server to:

(a) provide advertising content from an advertiser, wherein the advertising content comprises correct information about the product or service;

(b) control access to an online resource;

(c) receive an electronic request from the client computer to access the online resource;

(d) display the advertising content on the client computer;

(e) display an input request on the client computer to provide information about the product or service, wherein the information is available from the advertising content;

(f) receive an input response from the client computer to the input request;

(g) if the input response comprises the correct information, (1) allow the client computer to access the online resource;

(2) charge the advertiser for the advertisement; and (h) if the input response does not comprise the correct information, not charge the advertiser and display the advertising content in (d) free of charge.

18. A resource access control method comprising the steps of:

(a) providing advertising content from an advertiser stored on a server, wherein the advertising content comprises correct information about the product or service;

(b) providing an online resource to which access is controlled by the server, wherein the online resource is not related to the product or service;

(c) receiving an electronic request to access the online resource;

(d) transmitting computer executable code to a client computer such that when executed by a processor of the client computer causes the client computer to display the advertising content, wherein the transmitting comprises:

(i) generating a captcha test;

(ii) transmitting computer executable code to the client computer such that when executed by a processor of the client computer causes the client computer to display the captcha test and the advertising content;

(e) transmitting computer executable code to the client computer such that when executed by a processor of the client computer causes the client computer to display an input request to provide information about the product or service, wherein the input request comprises a question about the product or service, wherein the advertising content comprises the information;

(f) receiving an input response from the client computer to the input request; and (g) if the input response comprises the correct information, (1) allowing the client computer to access the online resource (2) charging the advertiser for the advertisement; and (h) if the input response does not comprise the correct information, not charging the advertiser wherein the step of not charging comprises displaying advertising content in (d) free of charge.

* * * * *